US008702208B2

(12) United States Patent
Wong

(10) Patent No.: US 8,702,208 B2
(45) Date of Patent: Apr. 22, 2014

(54) ACHIEVING ACCURATE PAGE YIELDS

(75) Inventor: Marvin G. Wong, Happy Valley, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 108 days.

(21) Appl. No.: 13/196,722

(22) Filed: Aug. 2, 2011

(65) Prior Publication Data

US 2013/0033546 A1 Feb. 7, 2013

(51) Int. Cl.
*B41J 2/04* (2006.01)

(52) U.S. Cl.
USPC ..... 347/54; 347/7; 347/94; 347/65

(58) Field of Classification Search
USPC ..... 347/6, 7, 15–17, 20, 44, 47, 56, 61–65, 347/67, 84–86, 92–94
See application file for complete search history.

(56) References Cited

U.S. PATENT DOCUMENTS

| | | | | |
|---|---|---|---|---|
| 4,746,935 | A * | 5/1988 | Allen | 347/98 |
| 5,793,393 | A * | 8/1998 | Coven | 347/65 |
| 6,398,329 | B1 * | 6/2002 | Boyd et al. | 347/7 |
| 6,843,545 | B2 | 1/2005 | Lapstun et al. | |
| 6,863,364 | B2 | 3/2005 | Russell et al. | |
| 7,744,181 | B2 | 6/2010 | Lapstun et al. | |
| 7,747,180 | B2 | 6/2010 | Wittenauer et al. | |
| 2008/0131146 | A1 | 6/2008 | Kendall | |
| 2009/0128596 | A1 | 5/2009 | Babu | |

* cited by examiner

*Primary Examiner* — Juanita D Jackson

(57) ABSTRACT

A system for achieving accurate page yields includes a first droplet generator comprising a nozzle aperture with a first cross sectional area and a first passageway to an ink reservoir. A second droplet generator includes a nozzle aperture with a second cross sectional area that is larger than the first cross sectional area and a second passageway to the ink reservoir with minimum cross sectional area that is smaller than the second cross sectional area. A method for achieving accurate page yields is also provided.

20 Claims, 9 Drawing Sheets

ACHIEVING ACCURATE PAGE YIELDS

BACKGROUND

In the printing industry, ink is often sold in prepackaged containers that are advertised or labeled with a target number of pages that can be printed with the ink. Achieving accurate page yields using the ink in the container fulfills user expectations, allows for accurate scheduling for replacement ink cartridges, and maintains print quality. Ideally, the amount of ink in the container would be just enough to print the target number of pages. However, variations in printheads, print settings, page content and other factors can cause the target number of pages to be missed. There may be too little ink to reach the target number of pages or excess ink remaining in the container after the target number of pages has been met.

BRIEF DESCRIPTION OF THE DRAWINGS

The accompanying drawings illustrate various examples of the principles described herein and are a part of the specification. The illustrated examples are merely examples and do not limit the scope of the claims.

Throughout the drawings, identical reference numbers designate similar, but not necessarily identical, elements.

DETAILED DESCRIPTION

As discussed above, ink containers can be labeled with a target number of pages that can be printed with the ink in the container. The accuracy of the page yield produced using the ink can influence user expectations, print quality, life cycle management and waste generated during the printing process. However, variations in printheads, print settings, page content and other factors can cause the page target to be missed.

One factor which can improve the accuracy of the page yield is an accurate understanding of how much ink is in the container throughout the printing process. Accurate measurements of the ink remaining in the container can allow print settings to be adjusted during printing to meet the page target. However, making accurate measurements of ink remaining in the container can be challenging. For example, ink may be contained in a foam filled container. As ink is dispensed onto the substrate, more ink wicks out of the foam to the printhead. Using foam to contain ink has a number of advantages, but directly measuring the amount of ink remaining in the foam is difficult. Directly measuring the amount of ink remaining in other types of ink containers, such as spring bags and integrated printhead pens can be similarly difficult.

As a result of the difficulty in making accurate measurements of the ink levels, ink containers are often designed to contain more ink than is typically necessary to meet a page target. The ink containers and ink amounts are determined using statistical measures to account for manufacturing and usage variations. For example, a large population of printheads is tested to determine how much ink is consumed by each printhead. The amount of ink in the container is then selected so that the vast majority of the printers will meet the page target. However, this results in larger ink containers, wasted ink, and uncertainty in the actual number of pages that can be printed using the ink containers.

The present specification describes systems and methods for accurately estimating ink remaining in ink containers and adjusting the print settings so that the target number of printed pages is generated without leaving large amounts of ink remaining in the ink container.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with the example is included in at least that one example, but not necessarily in other examples.

Figure 1A:
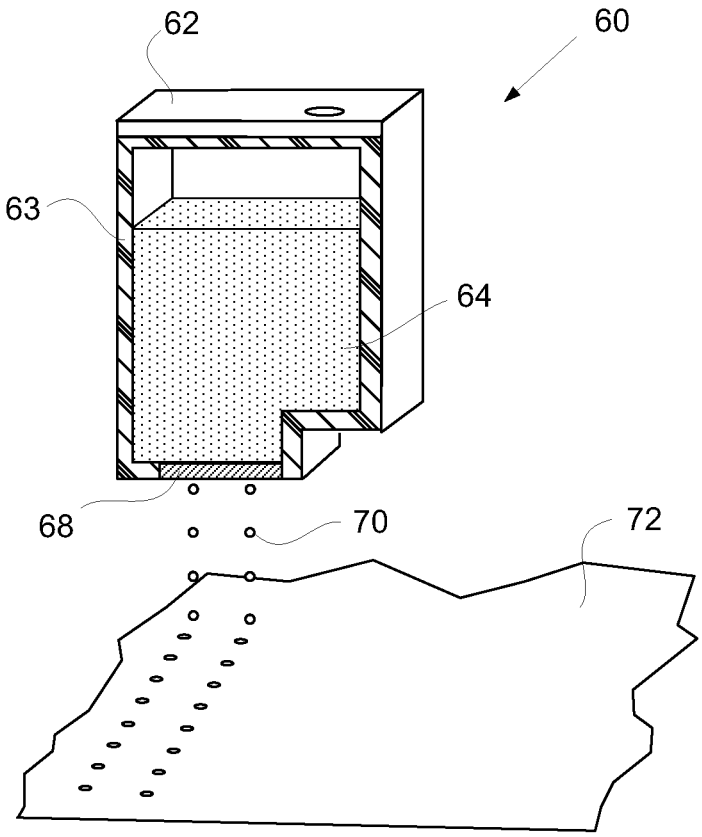
FIG. 1A is a diagram of one illustrative inkjet printing system, according to one example of principles described herein.

FIG. 1A is a diagram of an illustrative printing apparatus (60) which uses an inkjet printhead (62) to create an image on a substrate (72). The inkjet printhead (62) comprises a housing (63) which encloses an ink reservoir (64). A thermal inkjet die (68) is placed in the lower end of the inkjet printhead (62). The inkjet die (68) contains a number of droplet generators which eject droplets (70) to form the desired image on the substrate (72) in response to commands from the printer in which it is installed. The size of the droplet (70) that is ejected is determined by the geometry of the firing chamber, the capacity and operation of the heating element, the material properties of the fluid, and other factors. In many cases, extremely small drops (with masses of 1-10 nanograms) can be ejected at high frequencies from the firing chamber. The printhead (62) and substrate (72) are moved with respect to each other such that the ejected droplets (70) form the desired image on the substrate (72). As droplets (70) are ejected, the level of ink within the ink reservoir (64) naturally drops.

There are various methods of detecting low-on-ink or out-of-ink events within the inkjet printhead (62). One method uses a weight sensitive switch that is activated when the weight of the ink in the printhead (62) reaches a certain threshold. Another method counts the number of drops (70)

that have been ejected from the ink printhead (62) and sends a signal when that number has reached a certain threshold. As discussed above, current end-of-life detection methods are based on statistical averages of a large integrated printhead population. Integrated printhead end-of-life detection can consequently be inaccurate for individual printheads within the population, causing waste and negative user perception.

The inventor has discovered that the change in backpressure in the ink container as a result of dispensing ink can be used to accurately detect ink levels. The change in backpressure influences ink behavior within the droplet generators. Modified droplet generators can then be used to detect the backpressure and ink level.

Figure 1B:
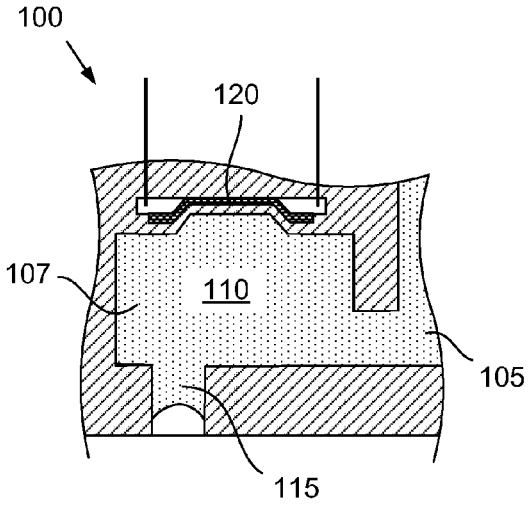
FIG. 1B-1D are cross-sectional diagrams showing the operation of thermal inkjet droplet generators, according to one example of principles described herein.

FIG. 1B is a cross-sectional view of one illustrative embodiment of a droplet generator (100) within an inkjet printhead (62, FIG. 1A). The droplet generator (100) includes a firing chamber (110) which is fluidically connected to an ink reservoir (105). A firing resistor (120) is located in proximity to the firing chamber (110). Fluid (107) enters the firing chamber (110) from the ink reservoir (105). Under isostatic conditions, the fluid does not exit the nozzle (115), but forms a concave meniscus within the nozzle exit.

Figure 1C:
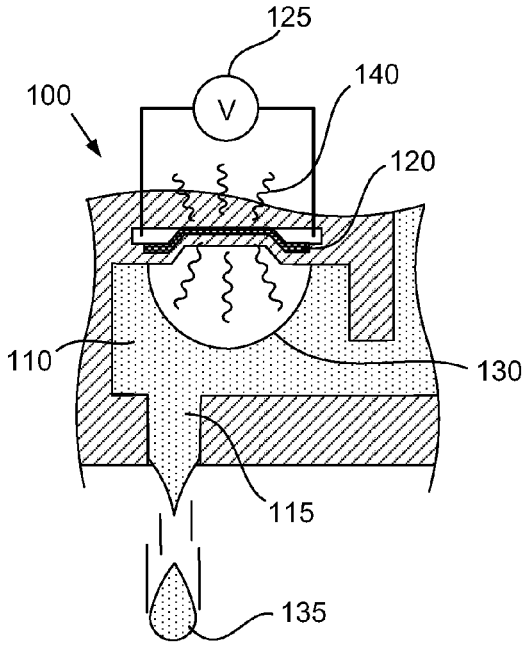

FIG. 1C is a cross-sectional view of a droplet generator (100) ejecting a droplet (135) from the firing chamber (110). According to one illustrative embodiment, a droplet (135) of fluid is ejected from the firing chamber (110) by applying a voltage (125) to the firing resistor (120). The firing resistor (120) can be a resistive material which rapidly heats due to its internal resistance to electrical current. Part of the heat generated by the firing resistor (120) passes through the wall of the firing chamber (110) and vaporizes a small portion of the fluid immediately adjacent to the firing resistor (120). The vaporization of the fluid creates a rapidly expanding vapor bubble (130) which overcomes the capillary forces retaining the fluid within the firing chamber (110) and nozzle (115). As the vapor continues to expand, a droplet (135) is ejected from the nozzle (115).

Figure 1D:
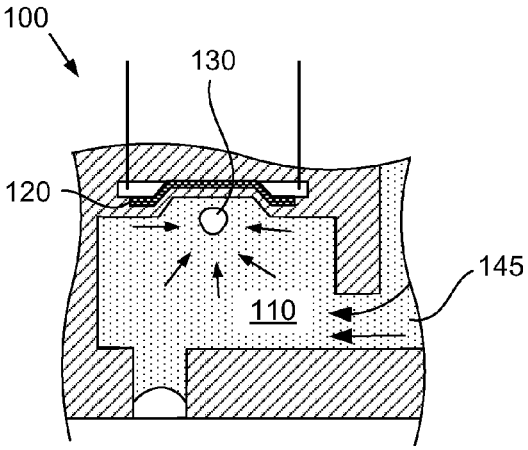

As shown in FIG. 1D, following the ejection of the droplet (135, FIG. 1C), the electrical current through the firing resistor (120) is cut off and the firing resistor (120) rapidly cools. The vaporized bubble rapidly collapses, pulling additional fluid (145) from the reservoir (105, FIG. 1B) into firing chamber (110) to replace the fluid volume vacated by the droplet (135, FIG. 1C). The droplet generator (100) is then ready to begin a new droplet ejection cycle.

Because of the small size of the droplet generator (100), capillary force/surface tension is a predominant force affecting the interaction of the ink with its surroundings. The capillary action occurs when the external intermolecular forces between the liquid and the solid walls are stronger than the cohesive intermolecular forces inside the liquid. The capillary forces tend to draw the fluid into the firing chamber (110) and hold it there. Ink in the firing chamber (110) and ink reservoir (105) are kept at a lower pressure than the outside air pressure. This backpressure pulls the ink meniscus up into the nozzle (115) in a concave shape, with the edges of the meniscus adhering to the nozzle walls and the center of the meniscus being drawn farther into the nozzle (115). This retains the ink within the nozzle (115) until firing.

Figure 2:
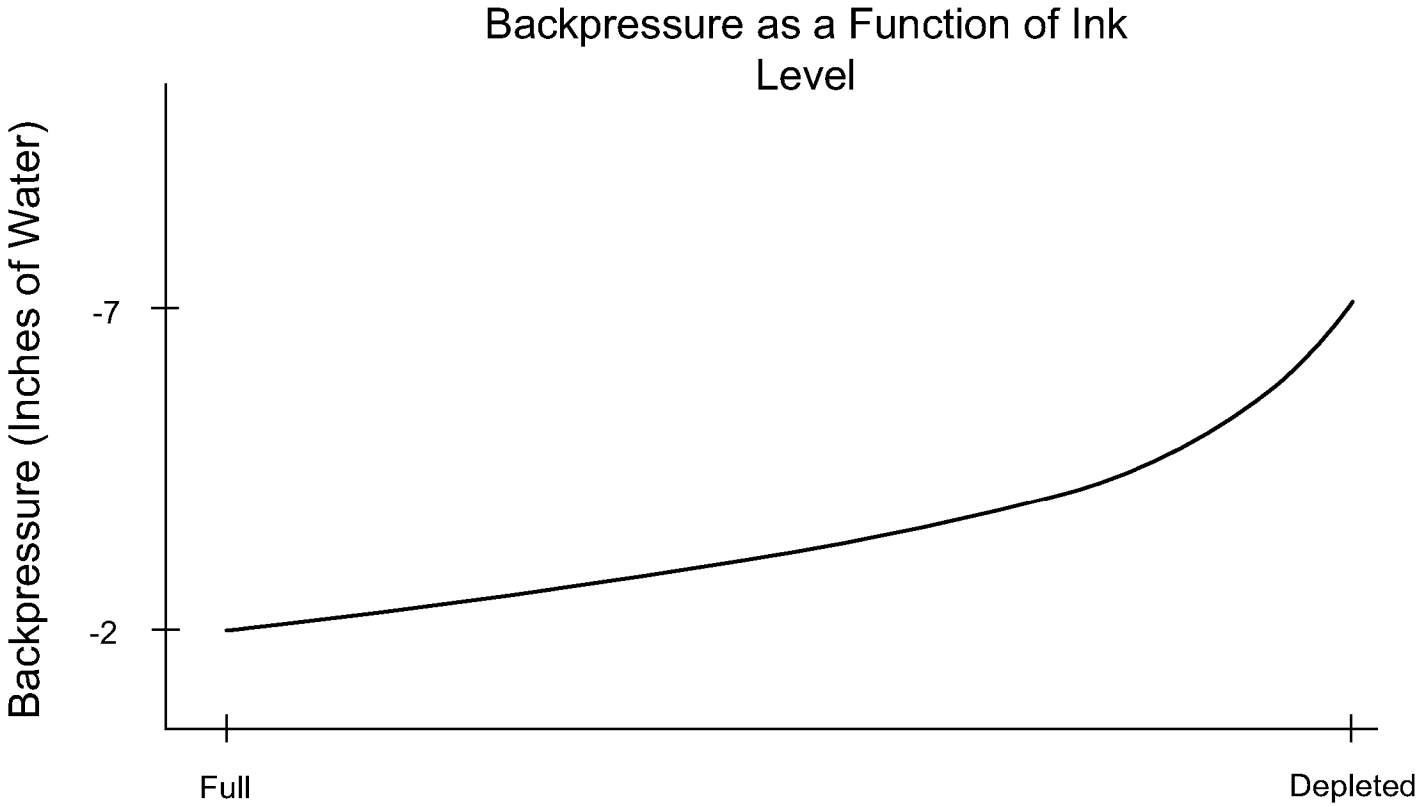
FIG. 2 is a graph of ink backpressure as a function of ink levels in an ink container, according to one example of principles described herein.

In a number of printer designs, the backpressure increases as the ink level in the ink container decreases. FIG. 2 is an illustrative graph which shows the backpressure in an inkjet printhead as a function of ink level. The vertical axis of the printhead shows increasingly negative backpressures in inches of water. The horizontal axis shows ink levels within an ink container. A full ink container is shown on the left and a depleted ink container is shown on the right.

In this example, when the ink container is full of ink, the backpressure is −2 inches of water. As the ink level decreases during printing, the backpressure continues to rise. The increase in backpressure occurs slowly at first, and then increases more rapidly as the ink is almost gone. In this implementation when the ink is depleted the backpressure is −7 inches of water. As used in the specification and appended claims, the term "smaller backpressure" refers to negative backpressures with small absolute values and the term "greater backpressure" refers to negative backpressures with higher absolute values. For example, −2 inches of water is a smaller backpressure than −7 inches of water.

The relationship between backpressure and the amount of ink in the ink reservoir is present in a wide variety of printing systems including integrated printhead systems, off-axis ink supplies, systems that use spring bag ink delivery systems, foam filled ink reservoirs, and other systems. For example, in a foam filled ink reservoir, capillary action draws the ink out of the foam and into the printhead. As the amount of ink in the foam decreases, higher negative pressures at the printhead are needed to draw the ink out of the foam.

After characterization of a printing system, the backpressure can be used to accurately measure the remaining amount of ink in the reservoir. This technique can be particularly useful where accurate direct measurements of the amount of ink in the reservoir are difficult.

Backpressure measurements can be made by using specially designed droplet generators as sensors. These droplet generators are designed to deprime at specific backpressures. As discussed above, the backpressure is a relative measurement of the difference between the ambient air pressure and the internal pressure of fluid in the ink cartridge. The meniscus responds to the backpressure. For example, the backpressure needed to pull the meniscus through a circular orifice (such as the nozzle opening) can be estimated using the following equation.

$$P=(2\sigma\cos(\theta-\alpha))/r \qquad \text{(Eq. 1)}$$

Where:

P=backpressure $\sigma$=ink surface tension $\theta$=ink contact angle $\alpha$=nozzle taper angle r=nozzle radius As can be seen from the equation above, the pressure needed to pull a meniscus through a circular opening decreases as the radius of the opening increases. It is easier for the meniscus to pass through a large opening than a small opening. When the backpressure exceeds a limit for the nozzle as defined above, the meniscus can detach from the nozzle and travel back through the firing chamber. This empties the firing chamber by allowing outside air to be sucked into the chamber. When the firing chamber is not full of ink, it is "deprimed" and cannot operate until it is again filled with ink. If the firing resistor is activated when the firing chamber is deprimed, the firing resistor has a greater likelihood of being thermally damaged. This is because the fluid which normally carries away heat generated by the firing resistor is absent.

If the meniscus does not encounter an opening smaller than the nozzle from which it just detached, it will continue through the firing chamber and become an expanding bubble in the ink reservoir. However, if the meniscus encounters a smaller opening than the nozzle, it will adhere to that opening until a higher backpressure is reached.

Figure 3A:
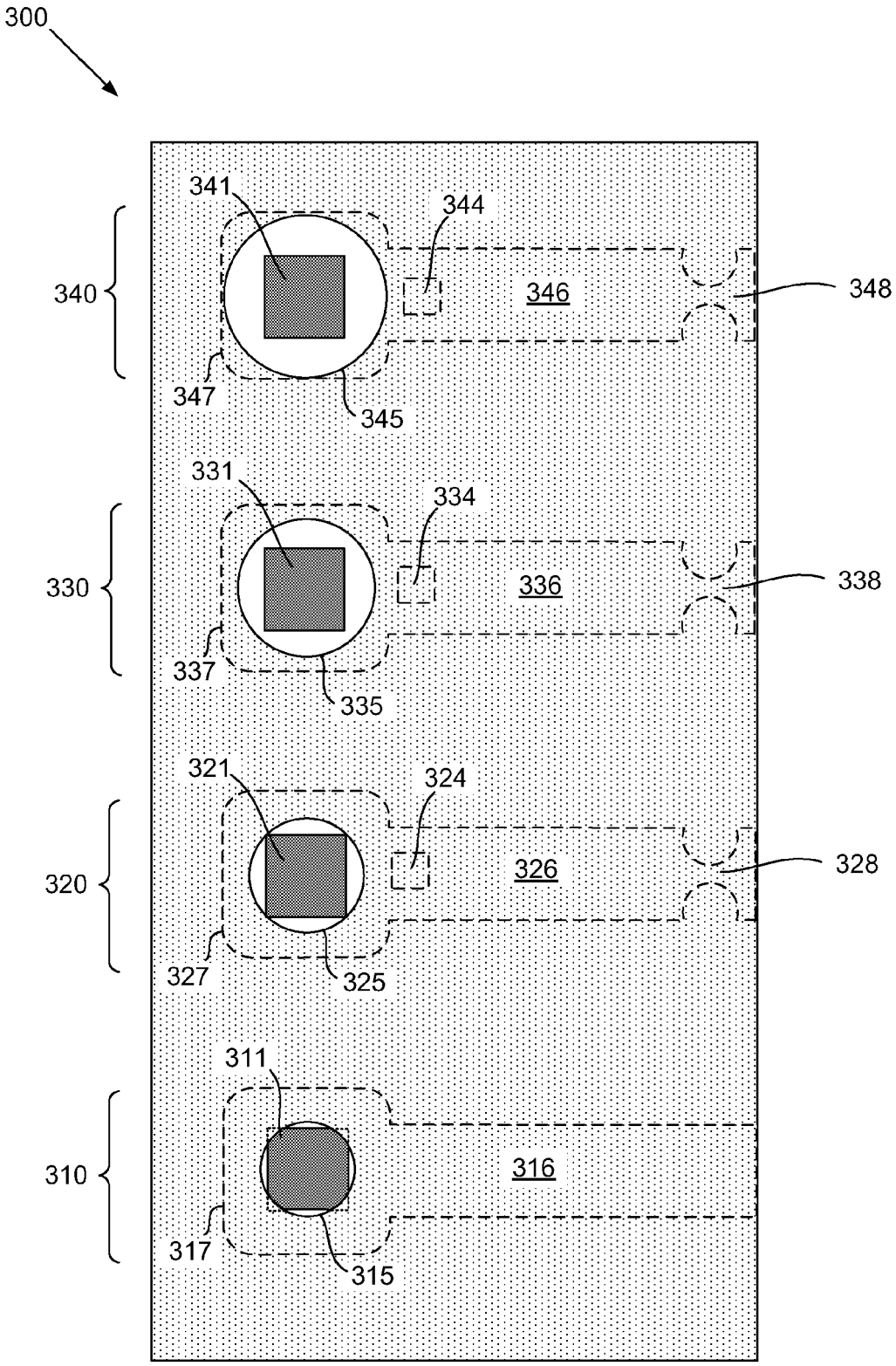
FIG. 3A is a bottom plan view of a printhead die with varying aperture sizes, according to one example of principles described herein.

A series of droplet generators with progressively larger nozzle openings will sequentially deprime as the backpressure increases. FIG. 3A is a bottom plan view of a portion of a thermal inkjet die (300) that includes a series of droplet generators (310, 320, 330, 340) with progressively larger nozzles openings. The internal structures of the droplet generators, such as the firing chambers (317, 327, 337, 347) and ink passageways (316, 326, 336, 346), are illustrated as dotted lines. Each firing chamber (317, 327, 337, 347) is connected to an ink reservoir by a passageway (316, 326, 336, 346). Firing resistors (311, 321, 331, 341) inside the firing chambers are visible through the nozzle apertures. The bottom droplet generator (310) includes a nozzle (312) with a standard diameter that is used to fire ink droplets onto the target substrate. A printhead typically contains an array with thousands of normal droplet generators which are actuated to deposit droplets that create the desired image on the substrate. The second droplet generator (320) has slightly larger nozzle opening (322), a secondary resistor (324), and a constriction (328) in the passageway (326) connecting the firing chamber (320) to the ink reservoir. The third droplet generator (330) has a larger nozzle opening (332), a secondary resistor (334), and a passageway constriction (338). The fourth droplet generator (340) has the largest nozzle opening (342) and a secondary resistor (344) and a passageway constriction (348) that is similar to the those in the second and third droplet generators (320, 330).

As the backpressure within the ink reservoir becomes greater, the fourth droplet generator (340) will be the first to deprime because it has the largest nozzle opening (342). As the backpressure continues to increase, the second and third droplet generators (320, 330) would sequentially deprime. However, the meniscus does not travel all the way into the ink reservoir but is trapped by the passageway constrictions (328, 338, 348). The passageway constrictions (328, 338, 348) can be designed so that the meniscus will not pass the constriction (328, 338, 348) through the complete range of anticipated backpressures. This prevents air from being sucked into the ink reservoir through the firing chamber sensors.

Figure 3C:
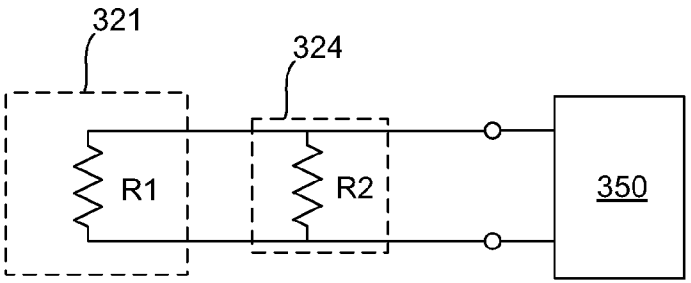
FIG. 3C is an electrical schematic of a firing and sensor resistor in a backpressure sensor, according on one example of principles described herein.
Figure 3B:
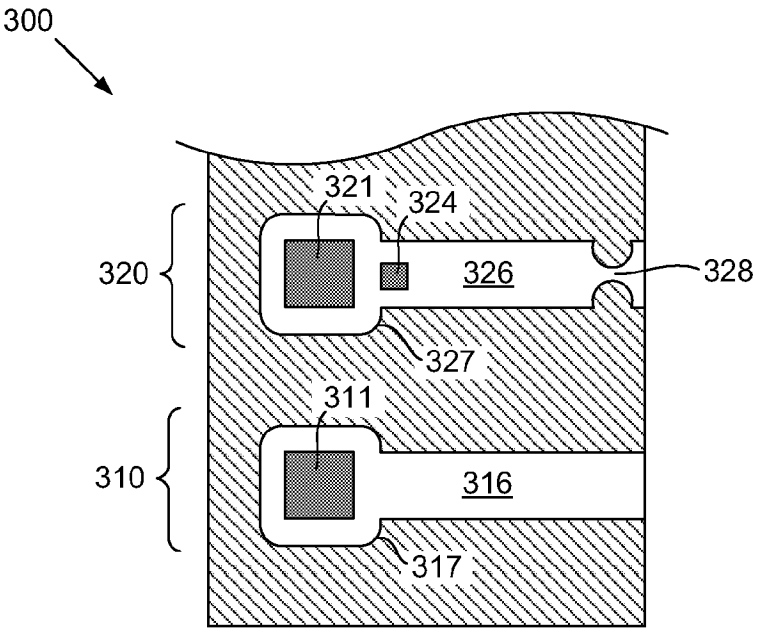
FIG. 3B is a cross-sectional view of a printhead die showing firing and sensor resistor configurations, according on one example of principles described herein.

FIG. 3B shows a cross sectional view of the inkjet die (300) which is taken through the interior of the droplet generators (310, 320). The first droplet generator (310) is a normal firing chamber which has a single firing resistor (311) and a more open passageway (316) to the ink reservoir. The passageway (316) may have a variety of configurations but for simplicity is illustrated as being straight.

The second droplet generator (320) is used as a backpressure sensor and includes two resistors (321, 324) and a constriction (328) in the passageway (326). In this example, the smaller resistor (324) is a sensing resistor that is designed to fail open when the firing chamber (327) becomes deprimed. This creates a predictable change in the resistance of the firing resistor circuit which can be detected to sense depriming of the firing chamber (327).

FIG. 3C shows a simplified electrical schematic of the of the second droplet generator (320, FIG. 3B). The resistance of the large firing resistor (321) is illustrated as resistance R1 and the resistance of the smaller sensing resistor (324) is illustrated as resistance R2. In this example, the resistances R1 and R2 are connected in parallel to a sensor circuit (350). During backpressure measurements, a sensor circuit (350) sends an electrical current through the firing resistor (321) and sensing resistor (324). If the depriming backpressure for this particular droplet generator (320, FIG. 3B) has not been exceeded, the firing chamber (327) will be full of ink. Consequently, the sensing resistor (324) will be able to distribute the heat it generates into the surrounding ink. This prevents the sensing resistor (324) from overheating and failing open.

The firing resistor (321) may or may not actually cause the ejection of a droplet out of the nozzle. The sensing of the backpressure will typically not occur during actual printing of a substrate. Instead, the backpressure sensing will be timed to occur during calibration or maintenance procedures. Any ink ejected by the droplet generators (320, 330, 340) can be contained and discarded to prevent undesirable print artifacts on the substrate.

Although the resistances R1 and R2 are shown being connected parallel, they could also be connected in other ways, such as individually, in series, or as part of a bridge circuit. In one example, the firing resistor (321) and the sensing resistor (324) have approximately equal resistances. In other examples, the resistors could have different resistances.

Figure 4A:
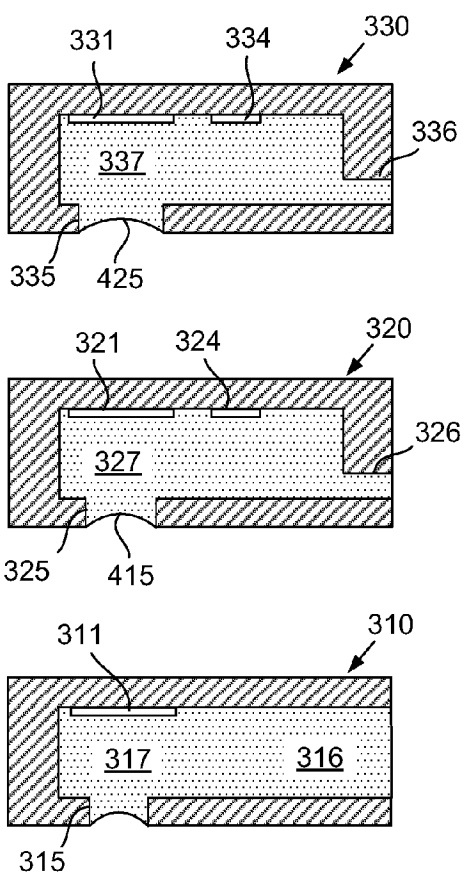
FIG. 4A-4C are diagrams showing the operation of backpressure sensors, according to one example of principles described herein.
Figure 4B:
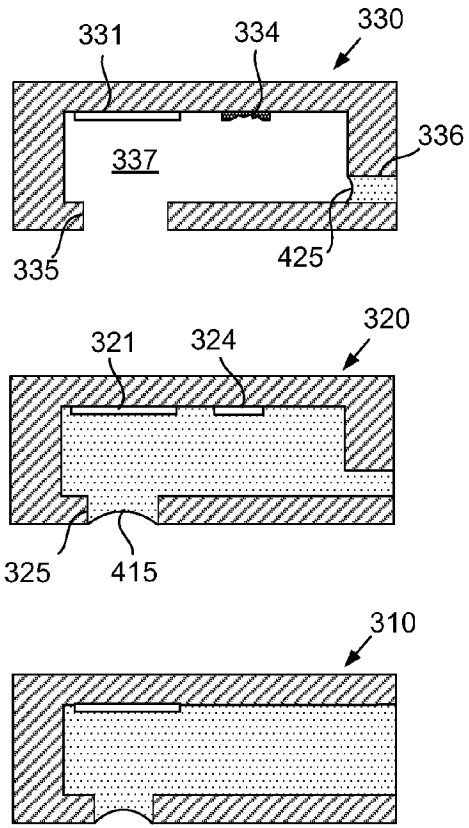
Figure 4C:
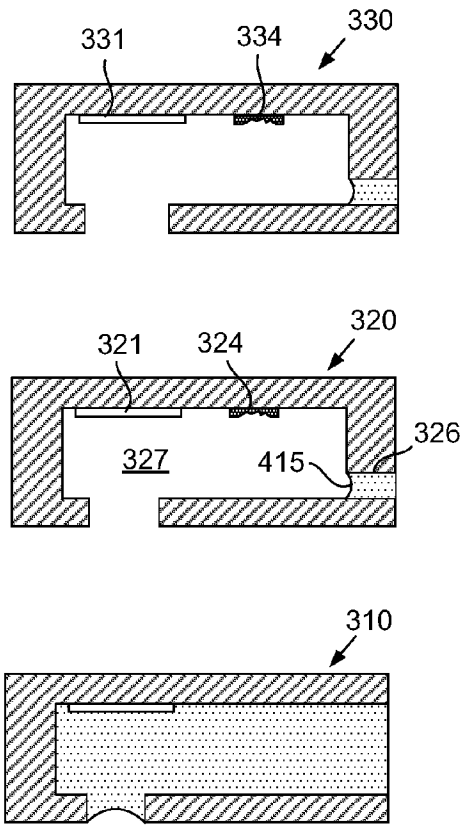

FIGS. 4A-4C are side cross sectional views of three of the droplet generators (310, 320, 330) shown in FIG. 3A. FIGS. 4A-4C show a time sequence of three droplet generators (310, 320, 330) as backpressure increases due to ink ejection, with FIG. 4A showing the droplet generators (310, 320, 330) at first smaller backpressure, FIG. 4B showing the droplet generators (310, 320, 330) at a second intermediate backpressure, and FIG. 4C showing the droplet generators (310, 320, 330) at a third greater backpressure.

Now referring to FIG. 4A, the first droplet generator (310) has a configuration which is designed to eject droplets out of a nozzle (315) to form an image on a substrate. As discussed above, the firing chamber (317) has only one firing resistor (311), a relatively small nozzle (315), and a passage (316) to the ink reservoir (105, FIG. 1B). The size of the nozzle (315) is such that the first droplet generator (310) will not deprime due to normal backpressures. The second droplet generator (320) acts as a backpressure sensor and has two resistors (321, 324) and a restricted passageway (326) sized to localize depriming to this droplet generator. Similarly, the third droplet generator (330) acts as a backpressure sensor and has two resistors (331, 334) and a restricted passageway (336) sized to localize depriming to this droplet generator. The second droplet generator (320) has a larger diameter nozzle (325) than the first droplet generator (310), but smaller than the third droplet generator (330). Consequently, the third droplet generator (330) will deprime at a lower backpressure than the second droplet generator (320). In FIG. 4A, all of the firing chambers (317, 327, 337) contain ink.

In FIG. 4B, more ink has been expelled by the printer and the backpressure becomes greater (more negative). In the third droplet generator (330) this increased backpressure pulls the meniscus (425) out of the nozzle (335). The meniscus (425) travels through the firing chamber (337) until it is trapped at the restricted passageway (336). This fills the firing chamber (337) with air. When an electrical current is passed through the firing resistor (331) and sensor resistor (334), the sensor resistor (334) overheats and blows out. This creates an open circuit at the sensor resistor (334).

A similar current is also passed through the resistors (321, 324) in the second droplet generator (320). Throughout this process, the meniscus (415) in the second droplet generator (320) remains in place in the smaller nozzle (315). Because the second droplet generator (320) has not been deprimed at this amount of backpressure, the electrical current does not blow out the sensing resistor (324) in the second droplet generator (320) and the resistances of the resistors (321, 324) remain substantially unchanged.

The sensing circuitry (350, FIG. 3C) detects the resistance of the second droplet generator (320) and third droplet generator (330). The sensing circuitry (350, FIG. 3C) detects the change in resistance in the third droplet generator (330) but detects no change in resistance in the second droplet generator (320). Thus, it can be determined that the backpressure which deprimes the third droplet generator (330) has been reached while the backpressure which deprimes the second droplet generator (320) has not.

In FIG. 4C, ink continues to be expelled by the printer and the backpressure continues to increase to levels greater than that described in FIG. 4B. In the second droplet generator (320), this backpressure pulls the meniscus (415) out of the nozzle (325) and back to the restricted passageway (326). This fills the firing chamber (327) of the second droplet generator (410) with air. When electrical current is passed through the firing resistor (321) and sensor resistor (324), the sensor resistor (324) overheats and blows out. This creates an open circuit at the sensor resistor (324). In one implementation, the resistance of the firing resistor (321) remains substantially unchanged and acts as a predictable and measurable resistance when the sensor resistor (324) is blown. The sensing circuitry (350, FIG. 3C) detects the change in resistance and equates this to a second predetermined backpressure. Throughout this sequence, the first droplet generator (310) remains primed and continues to dispense ink droplets during printing.

By using the backpressure data points generated by the second and third droplet generators (320, 330), the system can determine the current ink levels within the ink reservoir. The system can then modify printing parameters as needed to successfully reach the target number of printed pages.

Although only two droplet generators which sense backpressure are illustrated in FIGS. 4A-4C, any number of droplet generators could be used to sense backpressure. In general, the droplet generators configured as backpressure sensors are approximately the same size as normal droplet generators and can be constructed at the same time and using the same techniques/materials as the other droplet generators. Consequently, the additional cost in terms of time and materials of including droplet generators that act as backpressure sensors on the printhead can be minimal.

Droplet generators that act as backpressure sensors are not limited to the designs shown above or designs which are similar to the droplet generators. The droplet generators that act as backpressure sensors could have a variety of geometries, materials and operating characteristics. For example, a droplet generator could have a series of progressively smaller apertures through which the meniscus would pass as the backpressure increased. In another example, the sensor resistor could be constructed from a different material than the firing resistor.

A number of alternative techniques could be used to sense depriming. For example, the capacitance of a firing resistor may change when the droplet generator is deprimed. This change in capacitance could be used to sense depriming. Alternatively, the cooling profile of a firing resistor could be used to determine if the sensor has deprimed. The firing resistor would cool more slowly when the firing chamber is deprimed. In other examples, the electrical resistance/capacitance/inductance between two resistors in the same firing chamber could be sensed. If ink was present firing chamber, the measured electrical characteristic would have a first value or range of values. If ink was absent, the measured electrical characteristic could have a second value or range of values.

In one alternative embodiment, backpressure sensors are constructed from droplet generators which have different nozzle sizes but are otherwise identical to the array of droplet generators which produce images on the substrate. The depriming of specific sensors in response to a given backpressure could be detected by droplet detection sensors already present in the printing system. For example, the droplet generators that do not eject a droplet when the firing resistor is actuated could be identified as deprimed. To reduce the possibility of identifying droplet generators as deprimed which have failed for other reasons, several droplet generators with identical nozzle apertures could be used. When the majority of identical droplet generators in a group fail to eject droplets, the designed backpressure point can be assumed to have been reached. This decreases the likelihood that failure by any one sensor will cause a false backpressure reading. The principle of using redundant sensors can be used in any of the designs described herein.

Additionally, sensor failure can be identified if sensors designed to trigger at backpressures do not correlate. For example, if a high backpressure sensor designed to respond at −7 inches of water is triggered before sensors which are designed to respond at −3 and −4 inches of water are triggered, it can be assumed that the high backpressure sensor has failed.

Figure 5A:
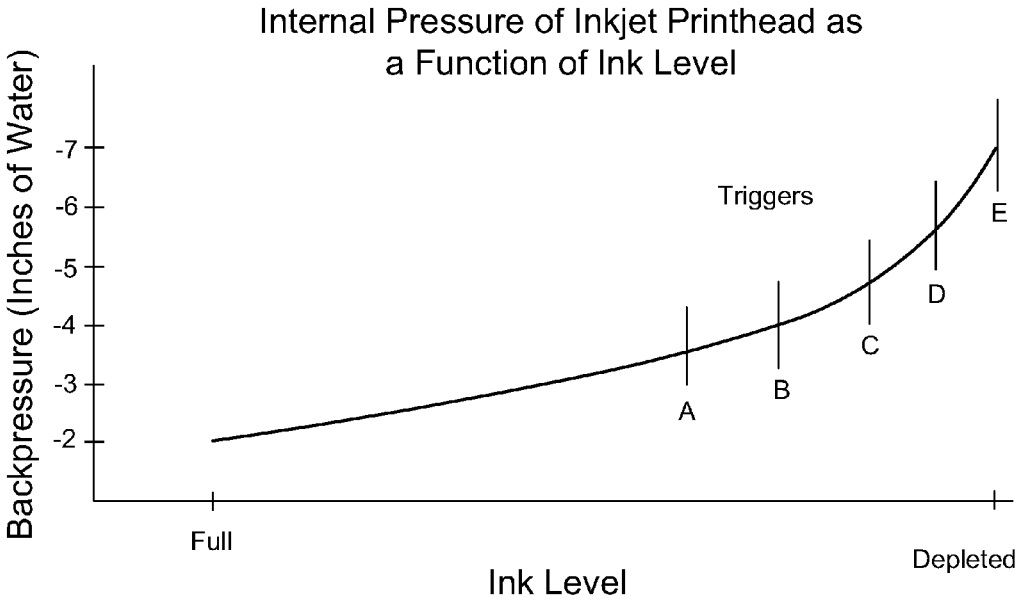
FIG. 5A is a graph of ink backpressure as a function of ink levels in an ink container labeled with trigger points of backpressure sensors, according to one example of principles described herein.

FIG. 5A shows the backpressure of an ink reservoir as a function of ink level as described in FIG. 2. In this example, five droplet generators (A-E) that act as backpressure sensors are included in the system. The droplet generators sequentially trigger as the backpressure becomes greater. The trigger points of the droplet generators (A-E) are labeled on the graph with the corresponding letter of the sensor. Sensor A triggers at approximately −3.5 inches of water, sensor B triggers at −4 inches of water, sensor C triggers slightly below −5 inches of water, sensor D triggers at approximately −5.5 inches of water and sensor E triggers at approximately −7 inches of water.

Figure 5B:
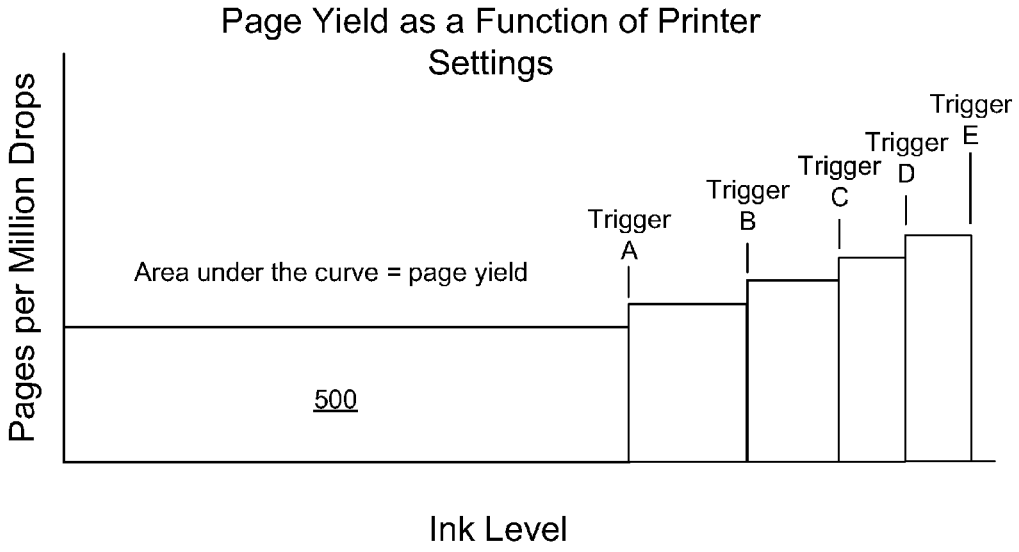
FIG. 5B is a graph showing printer settings and page yield as a function of ink level in an ink container, according to one example of principles described herein.

FIG. 5B describes an illustrative method for utilizing the backpressure data generated by the sensors (as described in FIG. 5A) to meet a target number of printed pages. The horizontal axis describes the ink level as sensed by the backpressure sensors. The vertical axis of the graph shows the number of pages which can be printed per million ejected drops. Lower numbers of pages printed per million drops are closer to the origin and higher numbers of pages printed per million drops are shown higher on the vertical axis. A lower number of pages printed per million drops equates to more ink deposited on each page. The area under the curve (i.e. the size of the boxes) represent the page yield. The area of a box represents the total number of pages printed at a specific "pages per million drops" setting.

According to one example, a print cartridge is initially loaded with slightly less ink that would be needed to print the target number of pages at a nominal "pages per million drops" setting. Until trigger A occurs, the printing proceeds with printing pages at the nominal "pages per million drops" setting. These pages are represented by the area of the first box (500). After trigger A occurs, the "pages per million drops" setting of the printer is increased. This results in fewer drops being deposited on each page and more pages being printed for each million drops. Thus, as the "pages per million drops" setting is increased more pages being printed with less ink consumed. However, this change in "pages per million drops" setting is not visually perceptible to the user. This sequence continues as each backpressure trigger occurs. At each step, the total number of pages remaining to be printed and the ink level are determined. A calculation is made or a table lookup is performed to determine how to adjust the "pages per million drops" setting to best meet the target number of printed pages. For example, if the printer is set to use 30 million drops per page before trigger A, after trigger A is detected it can be set to use 29 million drops per page.

In the example shown in FIG. 5B, the "pages per million drops" setting is incrementally increased to meet the target number of pages. However, the decreased amount of ink deposited on each printed page is typically imperceptible to the user, even at the highest "pages per million drop" setting. In some systems, only minor adjustments may need to be made. For example, when trigger A occurs, the system may determine that only a slight increase in the "pages per million drops" setting is needed. Subsequent measurements may verify that the system is on track to deliver the target number of printed pages without altering the print settings. Consequently, no changes are made at the subsequent trigger points.

Although the description above uses thermal inkjet printing mechanisms and processes to describe principles for sensing ink backpressure and meeting print targets, the principles can also be applied to other systems, such as piezo-electric driven printheads.

Figure 6:
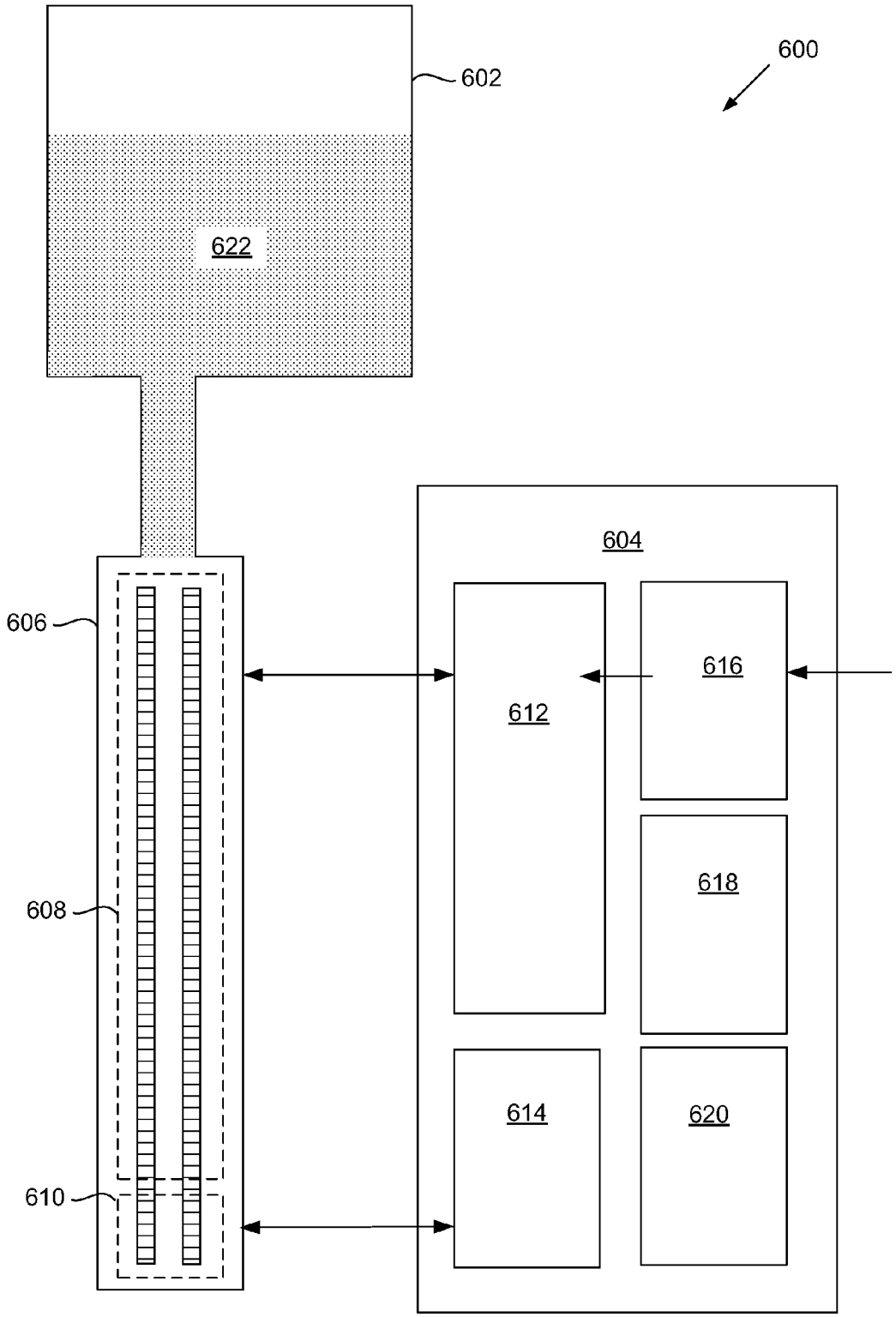
FIG. 6 is a block diagram of a printing system for achieving accurate page yields, according to one example of principles described herein.

FIG. 6 is a block diagram of a printing system (600) for achieving accurate page yields. As discussed above, the printing system (600) includes a printhead (606) fluidically connected to an ink reservoir (602). The ink reservoir (602) may be either an on-axis or off-axis ink supply. The printhead (606) includes an array of droplet generators which are divided into two groups. The majority of the array is made up of droplet generators (608) that are configured to dispense droplets onto a substrate to produce the desired image. These droplet generators (608) have substantially uniform nozzle apertures and passageways to the ink reservoir.

A subset of the droplet generators are used as backpressure sensors (610). As discussed above, these backpressure sensors (610) have nozzle apertures with cross sectional areas which are greater than the cross sectional area of the droplet generators (608) which produce the printed images. Among the backpressure sensors (610), the nozzle apertures can vary in size. Consequently, the backpressure sensors (610) will deprime through a range of backpressures and will deprime at backpressures which are lower than the backpressure at which the droplet generators (608) deprime. Although the nozzle apertures are illustrated and described above as being circular, they may have a variety of geometries.

The passageways between the backpressure sensors (610) and the ink reservoir (602) are restricted such that the minimum cross sectional area in the passageways is smaller than the cross sectional areas of the nozzles of the backpressure sensors (610). Further, the minimum cross-sectional area of the passageways can be smaller than the cross sectional area of the nozzles of the droplet generators (608).

As discussed above, the backpressure sensors (610) may use a variety of methods to sense depriming caused by backpressure in the ink reservoir (602). In one example, each of backpressure sensors (610) include both a firing resistor and sensing resistor. When a sensing resistor is activated in a deprimed firing chamber, the sensing resistor is designed to overheat and fail. The backpressure sensors (610) are electrically connected to sensing circuitry (614). The sensing circuitry (614) includes a resistance measurement component that measures the resistance of the sensing resistor. If the sensing resistor has maintained its original resistance, it can be determined that that particular backpressure sensor (610) is not deprimed and the backpressure at which that particular backpressure sensor (610) deprimes at has not been reached. However, if the resistance measurement component determines that the resistance sensing resistor has increased greater than a predetermined threshold, it is assumed that the backpressure at which the backpressure sensor (610) has deprimes has been reached.

The sensing resistor may not fail during the first electrical pulse that is sent through it after the firing chamber deprimes. A series of electrical pulses over a period of time may be applied to the sensor resistor to cause its resistance characteristics to permanently change. Typically this change will be a measureable increase in resistance, but in some embodiments it may alternatively be a decrease in resistance.

In the implementation shown in FIG. 6, the system also includes a look up table (620) which contains the correlations between the measured backpressure and the amount of ink (622) remaining in the ink reservoir (602). Using the measured backpressure, a logic controller (612) accesses the look up table (620) to determine how much ink (622) remains in the ink reservoir (602). The logic controller (612) also determines the number of pages remaining to be printed to reach the target number of printed pages. This can be accomplished by accessing a running count of the total number of pages printed since the ink reservoir/integrated print cartridge was installed and comparing the running count to the target number of pages which the ink reservoir/integrated print cartridge was configured to produce. The logic controller (612) can then adjust print settings (618) to produce modified print settings that will use the remaining ink (622) in the ink reservoir (602) to print the pages needed to meet the target number of pages. For example, if the current amount of ink (622) in the ink reservoir (602) is insufficient to print the needed pages, the modified print settings (618) may increase the number of pages printed with the remaining ink. The print settings (618) may include a "number of page printed per million drops" setting which can be adjusted without visibly compromising the quality of the printed images. The logic controller (612) then accepts the image data (616) and prints the image data according to the modified print settings to meet the target number of pages.

The system shown in FIG. 6 is only one simplified example of a system for achieving accurate page yields. A variety of components which may be present in a printer, such as paper handling mechanisms, stepper motors, and controllers have not been illustrated.

Figure 7:
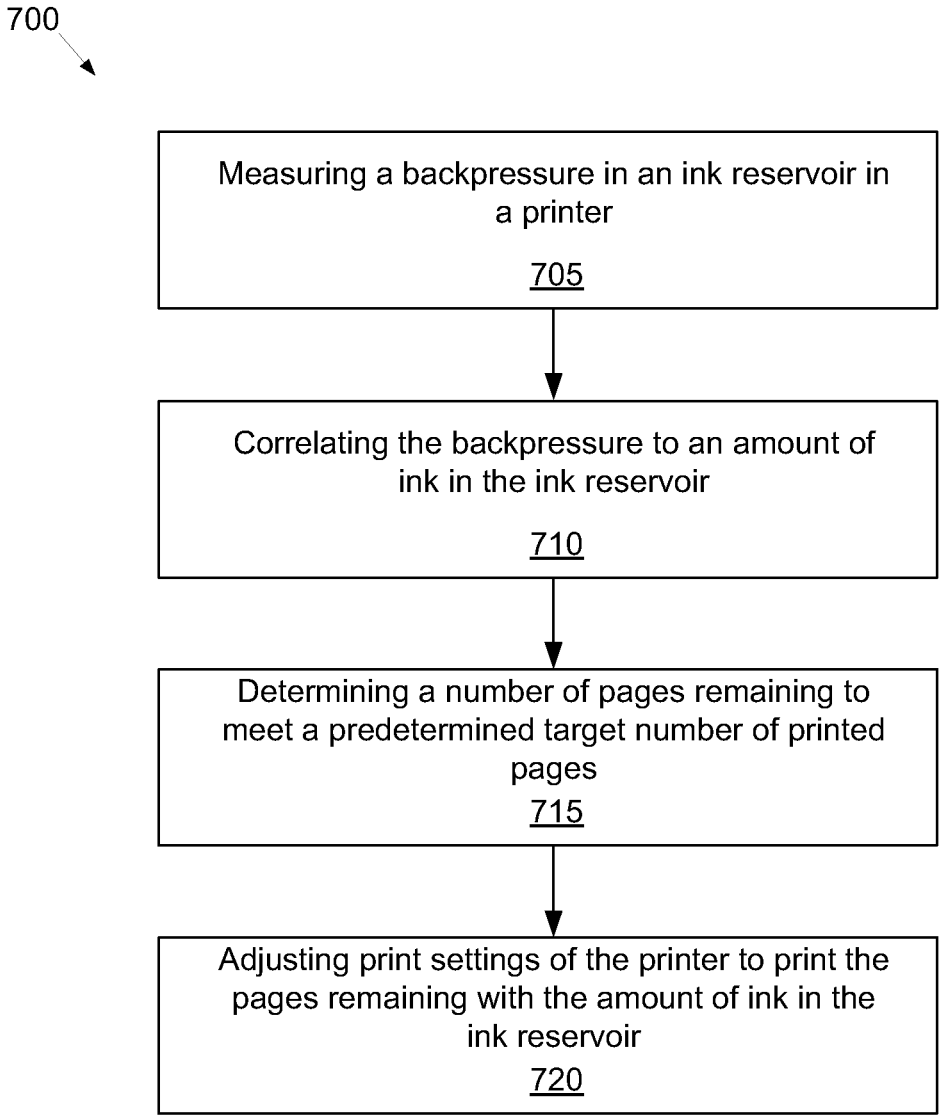
FIG. 7 is a flow chart of a method for achieving accurate page yields, according to one example of principles described herein.

FIG. 7 is flowchart of an illustrative method for achieving accurate page yields. The method includes measuring a backpressure in an ink reservoir in a printer to determine the amount of ink in the ink reservoir (block 705). Relationships between ink backpressure and ink amounts in an ink reservoir can be experimentally or analytically determined so that backpressure measurements can be translated into ink levels. As discussed above, a variety of methods may be used to measure backpressure. For example, backpressure in an ink reservoir may be measured by obtaining a printhead comprising droplet generators with varying size nozzle apertures that are configured to deprime at different backpressures. Sensing depriming of the droplet generators can include sending an electrical current through a sensing resistor in a firing chamber and measuring the resistance of the sensing resistor. If the resistance has significantly increased from a nominal value, it can be assumed that the backpressure sensor has deprimed.

The sensed backpressure can then be correlated to an amount of ink in the ink reservoir (block 710). For example, the depriming a specific backpressure sensor or group of backpressure sensors is determined. The depriming of these backpressure sensors corresponds to a specific backpressure or range of backpressures. This backpressure is related to the amount of ink in the ink reservoir by a predetermined relationship.

The number of pages remaining to meet a predetermined target number of printed pages is determined (block 715) and print settings are adjusted so that the printer can print the pages remaining with the amount of ink in the ink reservoir (block 720). For example, a setting such as "pages printed per million droplets" can be adjusted to increase the number of pages printed per unit of ink.

The method described above is only one illustrative example. Blocks described above may be combined, eliminated, added or modified. For example, the method may include filling the ink reservoir with less ink than will be used to print a predetermined target number of printed pages at a first printer setting. Alternatively, the method may include filling the ink reservoir with more ink than would be required to meet a predetermined target number of printed pages. In this scenario, the amount of ink deposited per printed page could actually increase as the number of printed pages approached the target number.

In conclusion, the systems and methods described above for achieving accurate page yields have a number of advantages. Because the target number of printed pages is consistently obtained, the user can be confident in budgeting for and purchasing replacement cartridges. In some examples, no extra ink needs to be included in the ink container design to ensure that every printer meets the target number of printed pages. Consequently, the container can be smaller, or for ink containers of the original size, the target number of printed pages can be increased.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A system for achieving accurate page yields comprising:

a first droplet generator comprising a nozzle aperture with a first cross sectional area and a first passageway to an ink reservoir; and a second droplet generator comprising a nozzle aperture with a second cross sectional area that is larger than the first cross sectional area and a second passageway to the ink reservoir with a minimum cross sectional area that is smaller than the second cross sectional area, in which the second droplet generator comprises a backpressure sensor to deprime at backpressures lower than the first droplet generator.

2. The system of claim 1, in which the minimum cross sectional area is smaller than the first cross sectional area.

3. The system of claim 1, in which the minimum cross sectional area is configured to localize depriming of the second droplet generator.

4. The system of claim 1, further comprising a firing resistor and a sensing resistor disposed in the second droplet generator.

5. The system of claim 4, further comprising sensing circuitry electrically connected to the sensing resistor.

6. The system of claim 4, in which the firing resistor and the sensing resistor are connected in parallel.

7. The system of claim 4, in which the sensing resistor is configured to fail open when activated in a deprimed firing chamber.

8. The system of claim 4, in which the sensing circuitry comprises a resistance measurement component for measuring a resistance of the sensing resistor.

9. The system of claim 1, further comprising a logic controller programmed for:

correlating ink backpressure to ink amounts in an ink reservoir;

filling the ink reservoir with less ink than will be used to print a predetermined target number of printed pages at a first printer setting;

printing pages at the first printer setting;

sensing backpressure of the ink reservoir;

correlating the backpressure of the ink reservoir to an amount of ink remaining in the ink reservoir;

determining the number of pages remaining to be printed to meet the target number of printed pages; and adjusting the first printer setting to a second printer setting that prints more pages with less ink to meet the target number of printed pages.

10. The system of claim 1, in which the second droplet generator is part of an array of second droplet generators that are used as backpressure sensors.

11. A system for achieving accurate page yields comprising:

a first droplet generator comprising a nozzle aperture with a first cross sectional area and a first passageway to an ink reservoir;

a second droplet generator comprising a nozzle aperture with a second cross sectional area that is larger than the first cross sectional area and a second passageway to the ink reservoir with a minimum cross sectional area that is smaller than the second cross sectional area; and a look up table for correlating backpressure to amount of ink remaining in the ink reservoir.

12. The system of claim 11, further comprising a logic module for:

comparing the measured resistance to a predetermined threshold to determine if the second droplet generator is deprimed;

accessing the look up table and determining amount of ink remaining;

determining the number of pages to print to reach target number of printed pages; and adjusting print settings to produce modified print settings.

13. The system of claim 12, in which the modified print settings increase the number of pages printed per million drops of ejected ink.

14. The system of claim 12, further comprising a controller for:

accepting image data; and printing the image data according to modified print settings.

15. A system for achieving accurate page yields comprising:

a first droplet generator comprising a nozzle aperture with a first cross sectional area and a first passageway to an ink reservoir;

a second droplet generator comprising a nozzle aperture with a second cross sectional area that is larger than the first cross sectional area and a second passageway to the ink reservoir with a minimum cross sectional area that is smaller than the second cross sectional area; and a logic controller programmed for:

measuring a backpressure in an ink reservoir in a printer;

correlating the backpressure to an amount of ink in the ink reservoir;

determining a number of pages remaining to meet a predetermined target number of printed pages; and adjusting print settings of the printer to print the pages remaining with the amount of ink in the ink reservoir.

16. The system of claim 15, in which measuring the backpressure in an ink reservoir comprises:

obtaining a printhead comprising droplet generators with varying size nozzle apertures that are configured to deprime at different backpressures; and sensing depriming of the droplet generators.

17. The system of claim 16, in which the sensing depriming of the droplet generators comprises applying an electrical voltage across a resistor in a firing chamber.

18. The system of claim 17, in which sensing depriming of the droplet generators further comprises measuring a resistance of the resistor in the firing chamber.

19. The system of claim 16, in which correlating the backpressure to an amount of ink in the ink reservoir comprises:

correlating the depriming of a droplet generator with a corresponding backpressure; and correlating the backpressure to an amount of ink in the ink reservoir.

20. The system of claim 15, in which adjusting print settings of the printer to print the pages remaining with the amount of ink in the ink reservoir comprises adjusting a setting to increase the number of pages printed for per unit of ink.

* * * * *